US008714073B2

(12) United States Patent
Burzel

(10) Patent No.: US 8,714,073 B2
(45) Date of Patent: May 6, 2014

(54) WEAPON ASSEMBLY, WEAPON SYSTEM AS WELL AS A METHOD FOR A WEAPON ASSEMBLY AND A METHOD FOR A WEAPON SYSTEM

(75) Inventor: Timo Burzel, Lahnau-Waldgirmes (DE)

(73) Assignee: Cassidian Optronics GmbH, Oberkochen (DE)

( * ) Notice: Subject to any disclaimer, the term of this patent is extended or adjusted under 35 U.S.C. 154(b) by 0 days.

(21) Appl. No.: 13/342,154

(22) Filed: Jan. 2, 2012

(65) Prior Publication Data

US 2012/0160089 A1 Jun. 28, 2012

Related U.S. Application Data

(63) Continuation of application No. PCT/EP2010/003945, filed on Jul. 2, 2010.

(30) Foreign Application Priority Data

Jul. 3, 2009 (DE) ..... 10 2009 031 620

(51) Int. Cl.
*F41G 1/00* (2006.01)

(52) U.S. Cl.
USPC ..... 89/41.17; 42/124

(58) Field of Classification Search
USPC ..... 89/41.01, 41.17; 42/120, 124, 105
See application file for complete search history.

(56) References Cited

U.S. PATENT DOCUMENTS

| | | | |
|---|---|---|---|
| 4,179,085 | A | 12/1979 | Miller, Jr. |
| 5,974,940 | A | 11/1999 | Madni et al. |
| 6,196,455 | B1 | 3/2001 | Robinson |
| 6,289,782 | B1 | 9/2001 | Watson, Jr. |
| 6,460,447 | B1 | 10/2002 | Meyers et al. |
| 6,708,597 | B2 | 3/2004 | Meyers et al. |
| 7,434,346 | B2 | 10/2008 | Scherpf |
| 2006/0201047 | A1 | 9/2006 | Lowrey, III |
| 2006/0272194 | A1 | 12/2006 | Guettner |

FOREIGN PATENT DOCUMENTS

| | | | |
|---|---|---|---|
| DE | 329142 | C | 11/1920 |
| DE | 1946972 | A1 | 4/1970 |
| DE | 39 33 042 | A1 | 6/1990 |

(Continued)

OTHER PUBLICATIONS

International Search Report dated Sep. 28, 2010 of international application PCT/EP 2010/003945 on which this application is based.

(Continued)

*Primary Examiner* — Gabriel Klein

(74) *Attorney, Agent, or Firm* — Walter Ottesen P.A.

(57) ABSTRACT

A weapon assembly includes a weapon (1) having a weapon barrel (2) which has a barrel bore axis (A), and has a trigger device (3), in which case an aiming device can be attached to the weapon (1) via a weapon-side attachment device (4, 7). A microcontroller (10) is provided, in which a deviation in the alignment of the barrel bore axis (A) of the weapon (1) with the weapon-side attachment device can be stored and can be read by an aiming device. The invention furthermore relates to a method for a weapon assembly, a weapon system and a method for a weapon system. The invention makes it possible to change fire control systems quickly from one weapon assembly to the other.

11 Claims, 7 Drawing Sheets

(56) References Cited

FOREIGN PATENT DOCUMENTS

| | | | |
|---|---|---|---|
| DE | 42 18 118 | A1 | 12/1993 |
| DE | 102 35 106 | A1 | 9/2003 |
| DE | 10 2008 019 126 | A1 | 10/2009 |
| EP | 0 249 679 | A2 | 12/1987 |
| EP | 1 772 695 | A1 | 4/2007 |
| GB | 2 171 572 | A | 8/1986 |
| GB | 2 225 844 | A | 6/1990 |
| WO | WO 98/51987 | A1 | 11/1998 |
| WO | WO 01/92814 | A2 | 12/2001 |

OTHER PUBLICATIONS

English translation of the Office action of the German Patent Office dated Jun. 28, 2010 in German patent application 10 2009 031 620.5 on which the claim of priority is based.

English translation of International Preliminary Report on Patentability of the international searching authority dated Jan. 17, 2012 in international patent application PCT/EP2010/003945 on which the claim of priority is based.

English translation of International Search Report and Written Opinion of the international searching authority dated Jan. 17, 2012 in international patent application PCT/EP2010/003945 on which the claim of priority is based.

WEAPON ASSEMBLY, WEAPON SYSTEM AS WELL AS A METHOD FOR A WEAPON ASSEMBLY AND A METHOD FOR A WEAPON SYSTEM

CROSS REFERENCE TO RELATED APPLICATIONS

This application is a continuation application of international, patent application PCT/EP 2010/003945, filed Jul. 2, 2010, designating the United States and claiming priority from German application 10 2009 031 620.5, filed Jul. 3, 2009, and the entire content of both applications is incorporated herein by reference.

FIELD OF THE INVENTION

The invention relates to a weapon assembly, a weapon system and to a method for a weapon assembly, a method for a weapon system and a weapon-side attachment device.

BACKGROUND OF THE INVENTION

It is generally known for weapons to be provided with an aiming device.

In this case, the term weapons means, in particular, weapons which are used in the infantry field, for example small arms, handguns, grenade launchers, grenade machine guns, recoilless weapons such as anti-tank weapons, et cetera. The invention can also be used for other weapons, for example mortars, and vehicle-based weapons.

Mechanical sights, for example a rear sight and a front sight or diopter devices, are known as traditional aiming devices. These are used, for example, on the G3 assault rifle made by Heckler & Koch. Furthermore, simple optical aiming devices with a reticle plate are known, for example aiming optics with magnification on anti-tank weapons for Dynamit Nobel Defence. Furthermore, aiming devices in the form of fire control systems (FLS) are nowadays increasingly being used. These fire control systems use an integrated rangefinder device to autonomously calculate the ballistic elevation angle and indicate this as a target marker in the optical field of view.

Particularly in the field of military use, systems (firing devices) are known which consist of a weapon and aiming device, in which the weapon is designed to fire aiming a limited number of shots, for example only one shot. In the case of systems such as these, the weapon is left behind operationally when a shot has been fired, in order to save the soldier from having to carry out the tedious task of transporting it back.

If the aiming device is one of the simple mechanical or optical aiming devices mentioned above, then these are likewise left behind as a component of the systems at the point of use.

If a fire control system is used as an aiming device, then, for cost reasons, it is generally not feasible to leave this behind at the point of use. In fact, it is desirable to use this fire control system for a plurality of weapons, possibly for different weapon types.

In order to allow a fire control system which is connected to a weapon to calculate and display the correct ballistic elevation angle, the center axis of the weapon barrel and the targeting optical element, for example, the corresponding light segment of a pixel display or a reticle plate of the aiming system, must have an essentially parallel basic alignment. In this case, an angle tolerance, defined in advance, of, for example, 0.1 mrad to 1 mrad must not be exceeded.

Until now, it has been possible to achieve this by preadjusting the mechanical interface element of the weapon, for example, a clamping rail, with respect to the weapon axis. Furthermore, the mechanical interface element of the fire control system, for example, an element which interacts with the clamping rail mentioned above, can be preadjusted for basic alignment of the fire control system. The described preadjustment has been found to be highly complex, in particular in the area of weapon to weapon interface elements.

While, in the case of the fire control device, its target mark can be adjusted with respect to the position of its interface element, for example, while being fitted to the device, thus allowing a defined basic alignment (referencing) to be achieved, this is not so simple for the weapon.

When the mechanical interface element of the weapon, for example a mounting rail, is being machined, angle tolerances between the interface element axis and the weapon barrel axis of less than 0.05 mrad must preferably be complied with, in order to keep the magnitude of the aiming line deviation as small as possible.

If the interface element of a weapon is already connected to it as an assembly, the cumbersome assembly must be held on a machine tool for (pre-) adjustment. The interface element of the weapon, in particular a mounting rail, is in this case then machined.

This has the disadvantage that, after this machining process, the machined surfaces can be surface-treated only with a very high level of complexity, since the machined rail may no longer be removed from the weapon barrel. This would otherwise result in maladjustment again.

Because of the narrow tolerance requirements, it must be expected that the relevant assemblies will be subject to an increased scrap rate, with a negative influence on the costs.

As an alternative to adjustment in the sense of machining after connection of the weapon and interface element, a movable connection could also be provided for adjustment between the weapon and its interface element. Since the weapon and its interface element are subject to powerful forces during use, this will, however, result in the risk of possible loss of adjustment during use in this case. Such adjustment must be free of play, must be adjustable in two axes and must have no aiming-line relevant deviations after the adjustment process, taking account of the potential environmental influences in accordance with the MIL STD 810 and DIN ISO 9022 tests, in particular the drop and shock tests.

SUMMARY OF THE INVENTION

The object of the invention is now to provide a weapon assembly having a weapon and a weapon-side attachment device which allows accurate firing after the attachment of an aiming device, in particular of a fire control system. Further objects of the invention are to provide a weapon system, a method for a weapon assembly and a weapon system, as well as a weapon-side attachment device, which allow accurate firing.

The weapon assembly of the invention includes a weapon having a weapon barrel defining a barrel bore axis (A); a trigger device; a weapon-side attachment device; an aiming device attachable to the weapon via the weapon-side attachment device; and, a microcontroller wherein a deviation of an alignment of the barrel bore axis (A) relative to the weapon-side attachment device can be stored and read out by the aiming device.

The aiming device may be in the form of a telescopic sight, in particular a fire control system (FLS). The aiming device may have processor electronics, for example a ballistic computer, which is then referred to as a fire control system. The processor electronics help to improve the hit confidence. In addition to the ballistic calculation, it can also carry out further tasks. Ballistic tables can also be stored, which are read. The fire control system may have an integrated range measurement device. Separately determined values, for example the range measurement via a separate rangefinder, can also be entered in the fire control system via one or more control elements. The fire control system can calculate the ballistic elevation angles, and can indicate these as a target marker or value indication in the optical field of view.

During or after the fitting of the weapon-side interface, also referred to as the weapon interface, for example, a mounting rail, to the weapon, the deviation between the rail alignment and the weapon barrel axis can be stored via an optoelectronic apparatus as an angle offset between the axis of the weapon interface and the axis of the weapon barrel in the weapon assembly, advantageously in the mounting rail. By way of example, this may be in the form of data information in a microcontroller.

The microcontroller can therefore contain the deviation magnitude in both axis directions (x, y axes) with respect to a reference position. The microcontroller is preferably mounted in or attached to the weapon interface and can be read by the processor electronics thereof during fitting of an aiming device, in particular of a fire control system. The fire control system therefore registers the deviation magnitudes between the weapon axis and the weapon interface axis as offset to its own basic adjustment.

The weapon assembly according to the invention and the weapon system according to the invention make it possible to provide a stable interface connection between a weapon and an aiming device, in particular a fire control system, without having to use a moving and/or a weapon-side attachment device which has to be adjusted mechanically. There is also no need for expensive reworking of an already fitted weapon interface. The weapon-side attachment device is also referred to as the weapon-side interface or the weapon interface.

The aiming device comprises a housing, which holds the aiming optics and an attachment device on the aiming device side, also referred to as the interface on the aiming device side. This may be in the form of a ring mounting device. The attachment device on the aiming device side may be formed integrally with the housing which holds the aiming optics. The attachment device on the aiming device side may be connected detachably or non-detachably to the housing which holds the aiming optics.

The attachment device on the aiming device side may contain sensors for measurement of ballistic influencing parameters. The influencing parameters measured there may be reflected directly in the field of view of the eyepiece of the aiming device, in particular by means of a menu choice. For example, the current settings of the elevation and azimuth turret, the firing angle, the temperature and/or the air pressure may thus be reflected in. In addition, tilting can also be indicated and monitored. Furthermore, it is also possible to store and call up data relating to different ammunition types, for example, one, two, three, four or more ammunition types, for example, up to six or ten ammunition types.

A weapon assembly, comprising a weapon and a weapon-side attachment device, and an aiming device, in particular a fire control system with its attachment device on the fire control system side (FLS interface), can thus be aligned with respect to one another in a simple manner. In this case, the weapon and the aiming device are connected to one another via the weapon-side attachment device and the attachment device on the aiming device side. For example, the connection may be in the form of a picatinny rail.

The weapon-side attachment device and the attachment device on the aiming device side can together form the transmission interface between the weapon assembly and the aiming device, via which the stored deviation between the barrel bore axis A and the longitudinal axis B of the attachment device can be transmitted to the aiming device, and can be recorded there as an offset value in the aiming line preset.

In particular, various types of weapon assemblies can be used successively with just one aiming device, with the aiming device, in particular the fire control system, reading the deviation magnitudes for the weapon assembly and registering them as an offset to its own basic adjustment. There is no need for complex mechanical adjustment.

The invention makes it possible for the user to dispense with a multiplicity of accessories, for example, thermometers, ballistics computers, firing angle compensators, which have to be carried separately. Therefore, the gunner can concentrate on what is essential and can at the same time save heavy baggage and costs for expensive equipment.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
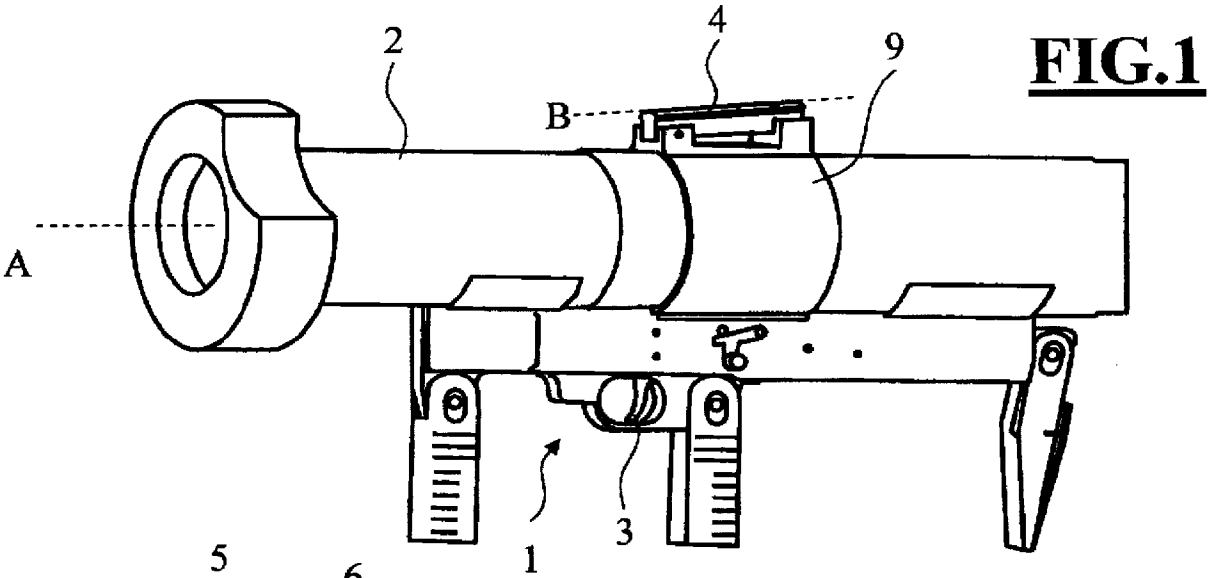
FIG. 1 shows a weapon assembly.

FIG. 1 shows a weapon assembly according to the invention which comprises a weapon 1 with a weapon barrel 2 as a projectile-guiding element, a trigger device 3 and a mechanical attachment device 4 for fitting an aiming device. The barrel bore axis is annotated A. The rail axis of the mechanical attachment device, which is in the form of a rail, is annotated B. This aiming device is not illustrated in FIG. 1. A telescopic sight with variable magnification, for example, 6-24 times and with an objective diameter of 72 mm may be provided here, by way of example, as an aiming device. This may have an integrated ballistic computer and internal reading, such that a user can read outputs from the ballistic computer and/or further details by means of the eyepiece.

Figure 2:
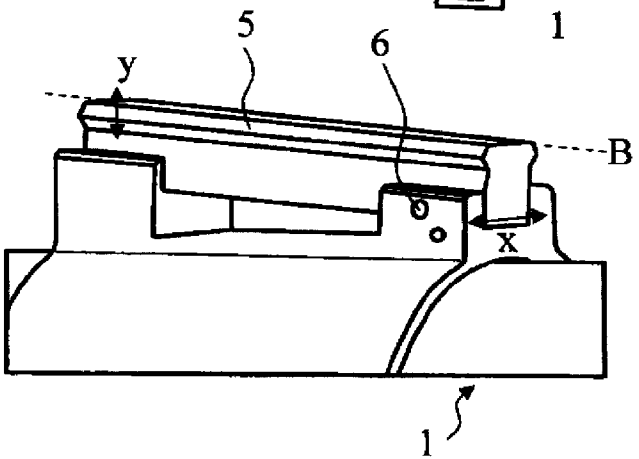
FIG. 2 shows an adjustable weapon-side mechanical attachment device.

FIG. 2 shows the weapon-side mechanical attachment device 4 in detail. This weapon-side mechanical attachment device 4 may also be referred to as the weapon-side interface and is fitted to a weapon 1, which is shown only partially. Adjustment can be carried out in the x and y directions by adjustment mechanisms, for example a screw 6. The adjustment options are illustrated schematically by double-headed arrows. The aiming device, which is not illustrated, may, for example, have an integrated ring mounting device or other mounting device as the attachment device on the aiming device side, and can be fitted to the rail 5 by means of this attachment device.

Figure 3:
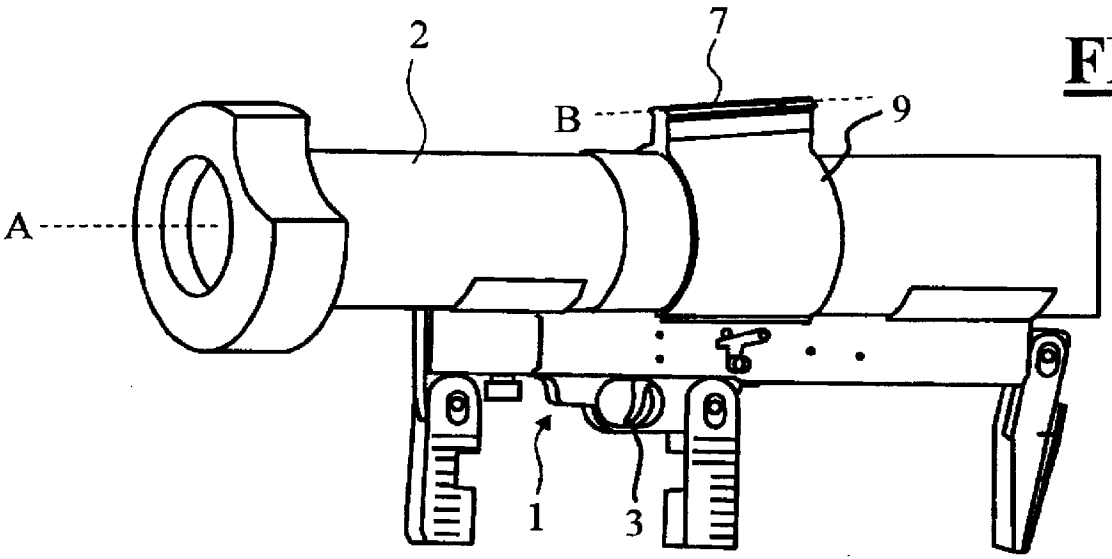
FIG. 3 shows another weapon assembly.
Figure 4:
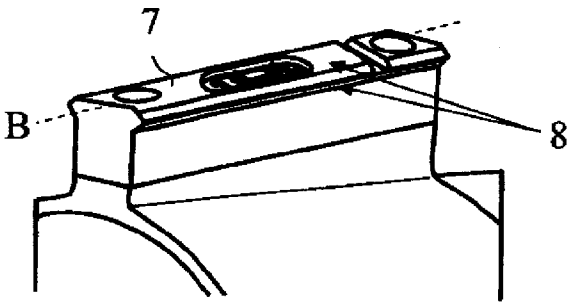
FIG. 4 shows a stationary weapon-side mechanical attachment device.

Instead of an adjustable attachment device 4, it is also possible to use a stationary attachment device 7 as illustrated in FIG. 3. The attachment device 7 may be machined in order in this way to allow an aiming device, which is to be attached, to be aligned precisely with respect to the weapon barrel. Possible points for machining are annotated by the reference symbol 8 in FIG. 4.

Both the weapon-side attachment device 4 and the weapon-side attachment device 7 have a ring 9, which surrounds the weapon barrel 2, and on whose upper face the rail 5 is arranged.

When the mechanical attachment device (4, 7) is being attached to the weapon 1, care must be taken to ensure that the attachment device (4, 7) is aligned with respect to the weapon 1, such that, when the aiming device is subsequently attached to the weapon 1 via the attachment device (4, 7), the barrel bore axis of the weapon barrel 2, which is annotated A, and the optical axis of the aiming device run essentially parallel.

In order to allow an aiming device, which is connected to a weapon, in particular a fire control system, to calculate and display the correct ballistic elevation angle, the axis of the weapon barrel and the basic alignment of the sight system must be basically aligned such that they are essentially parallel.

The position of the axis B of the weapon-side mechanical interface, for example the rail 5, with respect to the barrel bore axis A of the weapon barrel 2 which then results can be determined via a measurement system, preferably an external digital-optical measurement system, and can be stored via subsequent data conversion as an angle magnitude in two coordinates in a microcontroller on the weapon assembly side. This microcontroller may be in the form of an electronic, optical, radio or mechanical storage and reading element. An electronic memory 10 may be in the form of a weapon-side controller of a weapon system with its own data bus system. A serial data bus, $I^2C$ (inter-integrated circuit) from Philips Semiconductors or TWI (Two-Wire-Interface) may be used as a data bus for this data interface.

Figure 5:
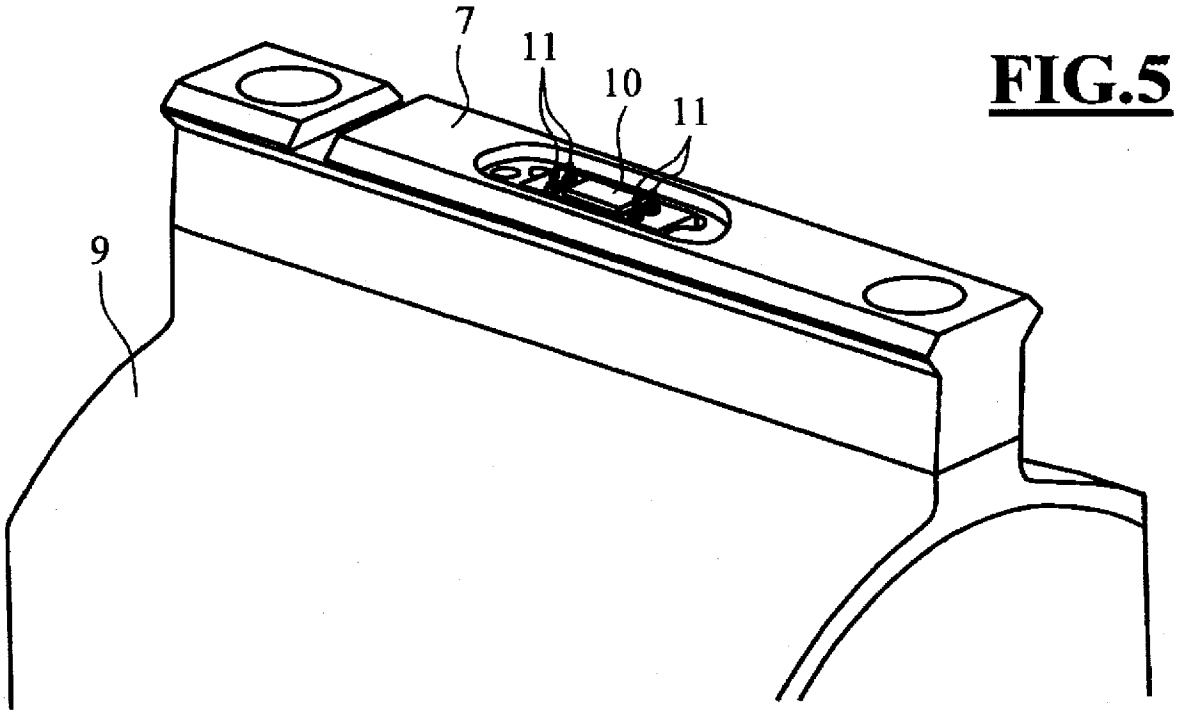
FIG. 5 shows a microcontroller.

FIG. 5 shows an electronics board with a microcontroller 10 and four contact interfaces 11. The contact interfaces, which are in the form of plug contacts here, can transmit data from the microcontroller 10 to the aiming device, in particular to the fire control system. The data can be transmitted via various types of interface: mechanical, radio, coils (RFID, IR barcode (linear or 2D)).

Figure 6:
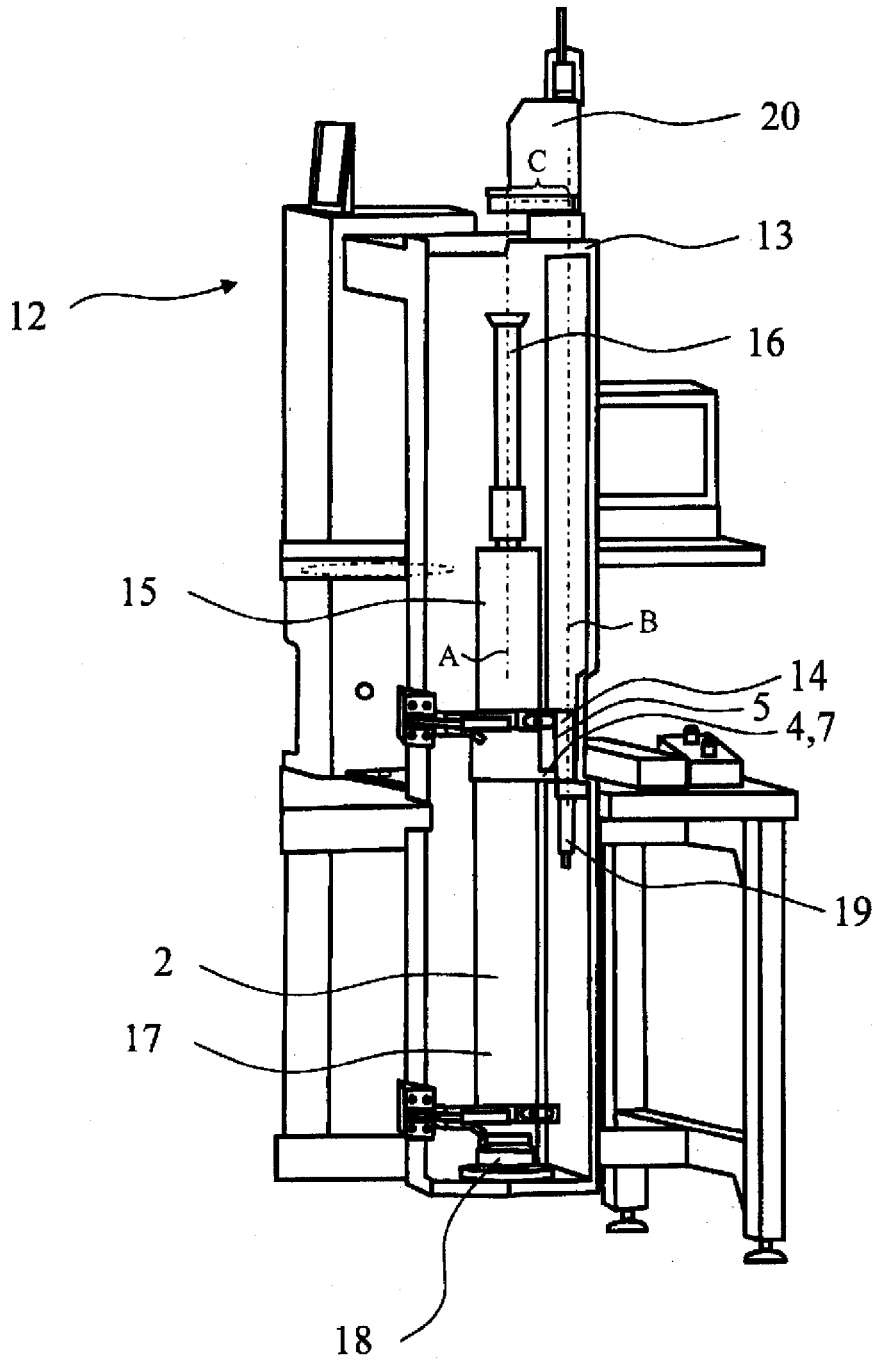
FIG. 6 shows a programming device.

FIG. 6 shows a programming device 12. A weapon barrel 2 is inserted into a holder 13. The weapon barrel 2 has already been provided with an attachment device (4, 7). Adjustment optics 14 have been fitted to the attachment device (4, 7) and are used to reproduce the position of the rail 5. A collimator 16, in particular a plug-in collimator, has been fitted in front of the muzzle end 15 of the weapon barrel 2. A light source 18 is arranged at the rear end 17 of the weapon barrel 2, passing light through the weapon barrel 2 and the collimator 16, and thus indicating the axis A of the weapon barrel 2. The collimator 16 is provided with a reticle for this purpose. A light source 19 is likewise associated with the adjustment optics 14. This passes light through the adjustment optics 14 and reproduces the alignment B of the rail 5. A camera 20 records both the direction beam on the axis A and that on the axis B. The offset C can therefore be determined by an image processing device. The offset value C is entered in the microcontroller as the "offset magnitude". The microcontroller can be provided on the weapon-side interface board and can carry out one or more of the following tasks: storage element, bus interface, data converter for weapon-side fuze, data interface for weapon-side environmental sensor system, for example, propellant charge temperature.

The aiming device, in particular the fire control system, contains an aiming line which, on the one hand, allows alignment of the aiming device, in particular of the fire control system, with the aiming object for rangefinding purposes and, on the other hand, allows defined alignment of the weapon system on the basis of measured influencing parameters. The ballistic influencing parameters may comprise, inter alia:

1. Object range
2. Temperature
3. Barometric air pressure
4. Air humidity
5. Firing angle and terrain angle
6. Vectorial wind influence In this case, one, two, three, four, five, six, seven or more, for example, up to 10 or 15, ballistic and/or other influencing parameters may be taken into account.

The present invention now also makes it possible to record the offset of the weapon-side mechanical interface element with respect to the barrel bore axis of the weapon barrel as an offset in the aiming line preset. This recording is preferably carried out as magnitude and direction indication in two coordinates. The offset is recorded by reading the weapon-side storage element 10.

Figure 7:
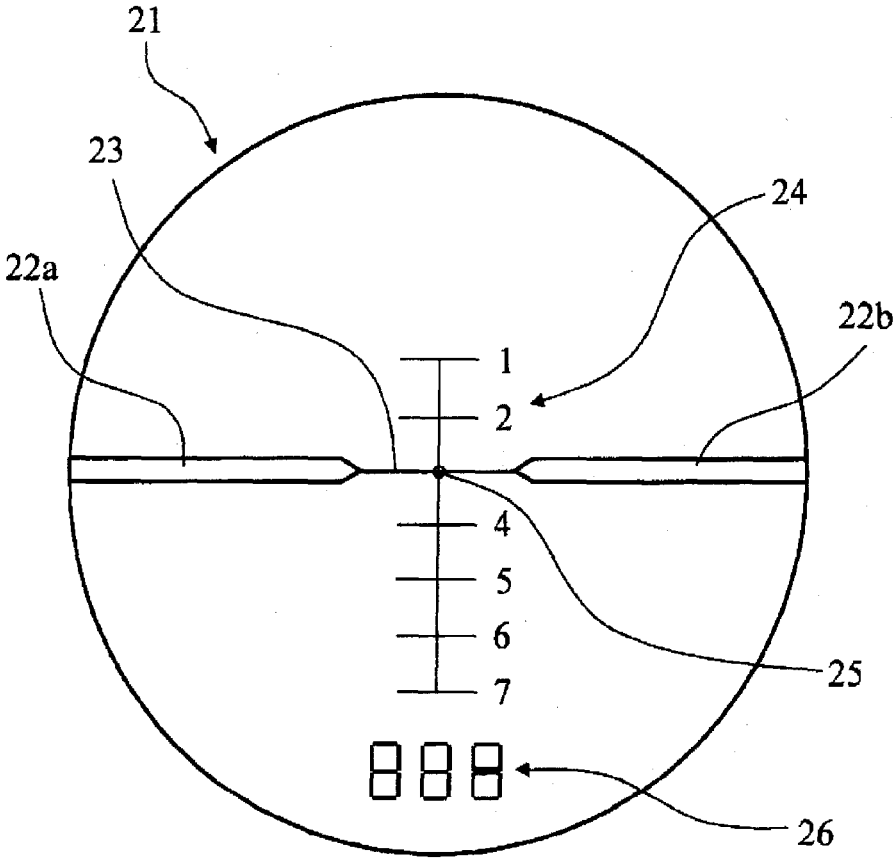
FIG. 7 shows an aiming marker with a standby sight.

FIG. 7 shows a target marker 21 with two horizontal bars 22*a* and 22*b*, which are connected to one another via a thin horizontal web 23. A line which runs at right angles to this and has a horizontal scaling for the elevation angles 1 to 7 represents a standby sight 24. An aiming point 25 is reflected in and has a difference from the weapon axis as a point of an aiming line. This is not parallel to the weapon axis by $\Delta x$ and $\Delta y$. Supplementary information 26, for example the result of a range measurement can be displayed for the user on the target marker 21.

Figure 8:
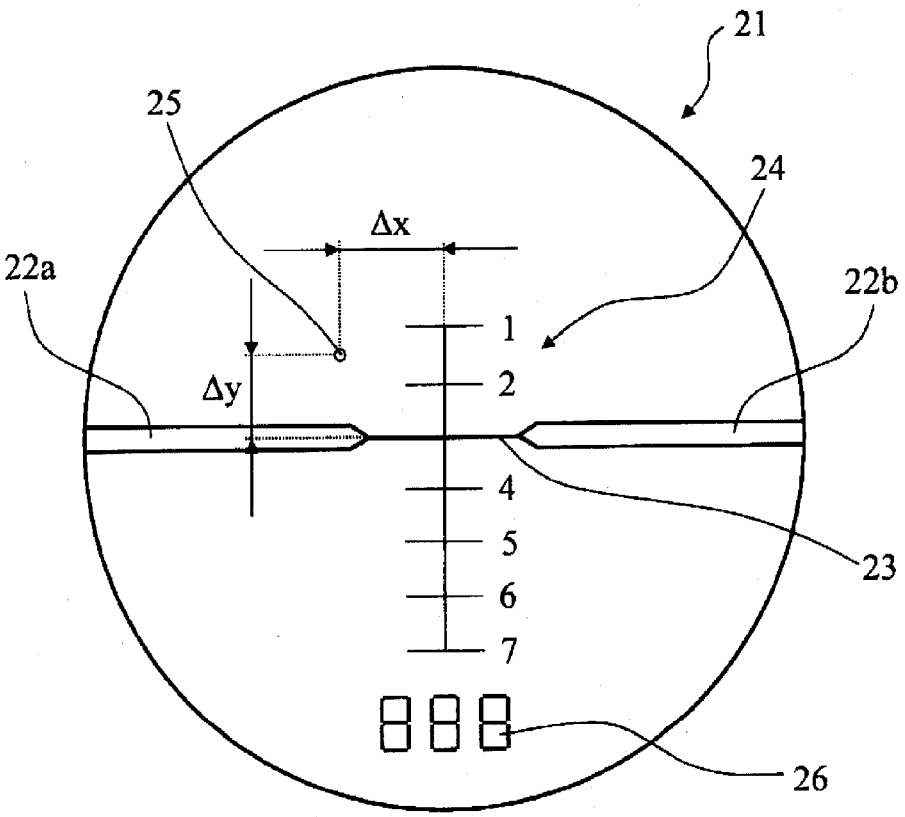
FIG. 8 shows a compensated aiming marker with a standby sight.

FIG. 8 shows a target marker 21 in which the difference, that is, the non-parallel ($\Delta x$, $\Delta y$) with respect to the weapon axis has been compensated for. In this case, ($\Delta x$, $\Delta y$) may be stored as values in the microcontroller in the weapon-side attachment device, in particular the mounting rail, of the weapon. The microcontroller can be programmed in an apparatus provided for this purpose by the weapon manufacturer.

The microcontroller has a storage medium, preferably a non-volatile storage medium (EEPROM).

Figure 9:
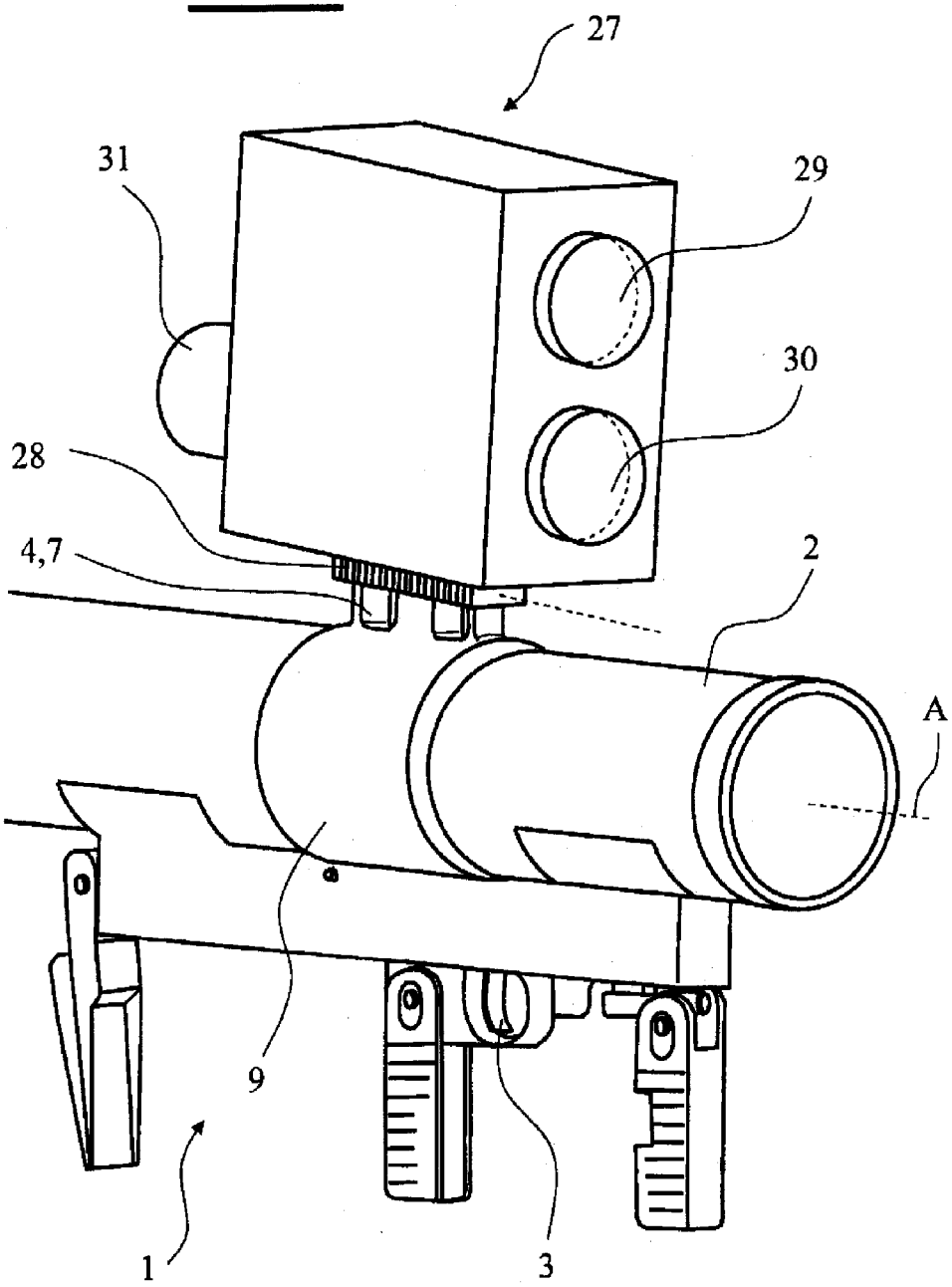
FIG. 9 shows a weapon assembly with a fire control system.

FIG. 9 shows a fire control system 27 which is mounted on the weapon 1 via the attachment device thereof on the fire control system side, also referred to as an interface 28 on the fire control system side, and the weapon interface of the weapon. The weapon interface may be in the form of an adjustable mechanical attachment device 4 or a stationary attachment device 7. In the assembled state, the contact interface 11 of the weapon-side attachment device 4 or 7 can interact with a corresponding contact interface of the attachment device 28 on the fire control system side of the fire control system 27.

The fire control system 27 has, inter alia, a laser rangefinder 29, an objective 30 and an eyepiece 31. An inclinometer can also be provided.

It is understood that the foregoing description is that of the preferred embodiments of the invention and that various changes and modifications may be made thereto without departing from the spirit and scope of the invention as defined in the appended claims.

LIST OF REFERENCE SYMBOLS

1. Weapon
2. Weapon barrel

3. Trigger device
4. Mechanically adjustable attachment device
5. Rail
6. Screw
7. Stationary attachment device
8. Point for machining
9. Ring
10. Microcontroller
11. Contact interface
12. Programming device
13. Holder
14. Adjustment optics
15. Muzzle end of the weapon barrel
16. Collimator
17. Rear end of the weapon barrel
18. Light source for the barrel bore axis
19. Light source for the interface axis
20. Camera
21. Target marker
22*a, b* Horizontal bars
23. Horizontal web
24. Standby sight
25. Aiming point
26. Additional information
27. Fire control system (FLS)
28. Interface of the fire control system (Attachment device on the fire control system side)
29. Laser rangefinder
30. Objective
31. Eyepiece
A Barrel bore axis
B Rail axis
C Offset between the barrel bore axis and the rail axis

What is claimed is:

1. A weapon assembly comprising:

a weapon having a weapon barrel defining a barrel bore axis (A);

a trigger device;

a weapon-side attachment device fixedly provided on said weapon;

an aiming device having an attachment unit and being removably attachable to the entirety of said weapon-side attachment device provided on said weapon via said attachment unit; and, an electronic, optical, radio or mechanical storage and reading element, wherein a deviation of an alignment of said barrel bore axis (A) relative to said weapon-side attachment device is stored on said electronic, optical, radio or mechanical storage and reading element and is configured to be read out by said aiming device when said aiming device is attached to said weapon-side attachment device provided on said weapon, and wherein said electronic, optical, radio or mechanical storage and reading element is arranged in or on the weapon-side attachment device provided on said weapon when said aiming device is attached to said weapon-side attachment device and when said aiming device is not attached to said weapon-side attachment device.

2. The weapon assembly of claim 1, wherein said aiming device is a firing control system.

3. The weapon assembly of claim 1, wherein said deviation in said alignment can be stored and can be read as an angular deviation and length deviation.

4. The weapon assembly of claim 1, wherein said electronic, optical, radio or mechanical storage and reading element is in the form of a weapon-side controller of a data bus system of a weapon system.

5. The weapon assembly of claim 4, wherein said electronic, optical, radio or mechanical storage and reading element has a serial data bus $I^2C$ or TWI.

6. The weapon assembly of claim 1, wherein said weapon-side attachment device defines a longitudinal axis (B) and said deviation of an alignment between said barrel bore axis (A) and said longitudinal axis (B) is stored and read out as an offset value.

7. The weapon assembly of claim 1, further comprising: said electronic, optical, radio or mechanical storage and reading element being arranged such that, when the weapon-side attachment device is attached to the attachment unit of said aiming device, said electronic, optical, radio or mechanical storage and reading element is connected to a reading device of said aiming device.

8. A method for a weapon assembly which includes: a weapon having a weapon barrel defining a barrel bore axis (A); a trigger device; a weapon-side attachment device fixedly provided on said weapon; an aiming device having an attachment unit and being removably attachable to the entirety of said weapon-side attachment device provided on said weapon via said attachment unit; and, an electronic, optical, radio or mechanical storage and reading element, wherein a deviation of an alignment of said barrel bore axis (A) relative to said weapon-side attachment device is stored on said electronic, optical, radio or mechanical storage and reading element and is configured to be read out by said aiming device when said aiming device is attached to said weapon-side attachment device provided on said weapon; the method being for detecting and storing of the position of the weapon-side attachment device, which is fixed to said weapon, with respect to the barrel bore axis (A) of said weapon as offset value, the method comprising the steps of:

determining the position of the barrel bore axis (A) and the position of a longitudinal axis (B) of the weapon-side attachment device by utilizing a digital-optical measurement system; and, via subsequent data conversion, storing the deviation between said positions as an offset value on said electronic, optical, radio or mechanical storage and reading element;

wherein said electronic, optical, radio or mechanical storage and reading element is arranged in or on the weapon-side attachment device provided on said weapon when said aiming device is attached to said weapon-side attachment device and when said aiming device is not attached to said weapon-side attachment device.

9. The method of claim 8, wherein said deviation is stored as an angular magnitude in two coordinates on said electronic, optical, radio or mechanical storage and reading element.

10. The method of claim 8, wherein said offset value is transmitted to said aiming device and is there considered in the aiming line preset.

11. The method of claim 10, wherein said aiming device is configured as a firing control system.

* * * * *